United States Patent [19]

La Pietra

[11] 4,089,143

[45] May 16, 1978

[54] METHOD OF CONVERTING SINGLE PANE GLASS TO MULTIPLE PANE, HERMETICALLY SEALED INSULATING GLASS WITHOUT REMOVING THE EXISTING GLASS SASH AND FRAME

[75] Inventor: Jack La Pietra, Turtle Creek, Pa.

[73] Assignees: James W. Mulvihill, Bethel Park; Youssef Amine, Pittsburgh, both of Pa. ; part interest to each

[21] Appl. No.: 782,292

[22] Filed: Mar. 28, 1977

[51] Int. Cl.[2] ..... E06B 7/12; E06B 3/26

[52] U.S. Cl. ..... 52/172; 52/208; 52/202; 52/741

[58] Field of Search ..... 52/393–403, 52/171, 172, 202, 203, 208, 304, 308, 616, 741

[56] References Cited

U.S. PATENT DOCUMENTS

| | | | |
|---|---|---|---|
| 2,177,001 | 10/1939 | Owen | 52/398 |
| 3,381,435 | 5/1968 | Smith | 52/403 |
| 3,758,996 | 9/1973 | Bowser | 52/172 |

*Primary Examiner*—James L. Ridgill, Jr.

[57] ABSTRACT

A method of converting single pane glass to multiple pane hermetically sealed insulating glass without removing the existing glass sash and frame by using a preformed elastomeric (neoprene) glazing gasket as a mechanical seal. The preformed neoprene rubber seal glazing gasket is supported on a suitable frame of metal, aluminum, or other construction material. The glazing gasket support frame is attached to the existing sash or frame with suitable fastner. The preformed elastomeric glazing gasket is mechanically compressed against the existing lite of glass by the force of the fastner when the support frame is tightened against the existing sash or frame. This mechanical compression of the preformed elastomeric glazing gasket against the existing lite of glass forms a seal that is impervious to air and water vapor. The preformed elastomeric glazing gasket is grooved for support of the second lite of glass that is required to form the multiple pane hermetically sealed insulating glass unit. To effect the seal between the glazing gasket and second lite of glass, a special rubber locking strip is inserted progressively into another groove that is provided in the preformed gasket. This puts the gasket under sufficient compression to produce the required sealing pressure between the neoprene and glass. A suitable water vapor removal desiccant is placed in another groove in the neoprene gasket in the air gap space between the multiple lites of glass to control condensation.

3 Claims, 3 Drawing Figures

METHOD OF CONVERTING SINGLE PANE GLASS TO MULTIPLE PANE, HERMETICALLY SEALED INSULATING GLASS WITHOUT REMOVING THE EXISTING GLASS SASH AND FRAME

This invention relates to a method of converting single pane glass to multiple pane hermetically sealed insulating glass without removing the existing glass sash and frame. Multiple pane hermetically sealed glass units are, of course, well known systems for reducing heat losses from buildings, residences, etc. For example, the U value (heat transfer coefficient) for vertical glass windows with single glazing is taken at 1.13 BTU per (sq ft) (hr) (deg. temperature difference) based on a 15 mph wind velocity. Where two vertical sheets are separated by a ¼ inch air space, $U = 0.61$ and if the air space is ½ inch, then $U = 0.55$, for ¾, $U = 0.54$ and for 1 inch, $U = 0.53$. The U value references were taken from the following sources: Handbook of Air Conditioning Heating And Ventilating, Strock and Koral, editors p. 2–175, Industrial Press Inc., New York, and ASHRAE Guide And Data book, 1963, Fundamentals And Equipment, p. 420, American Society Of Heating, Refrigerating, and Air-Conditioning Engineers, Inc., New York.

Using a standard 2 feet 10 inches × 1 foot 9 inches wood sash window as an example, it can be shown that window heat losses can be reduced substantially by converting from single glazing to multiple pane insulating glass. The glass area for the 2 feet 10 inches × 1 foot 9 inches window is 4.96 sq. ft. A single pane window has a U value of 1.13. Based on a 0° to 70° F temperature differential, the heat loss for the glazed windows (single pane) is; 1.13 × 4.96 × 70 or 392.3 BTU per hour. A dual glazed window with an air gap of ¾ inch has a U value of 0.54. The corresponding heat losses are 184 BTU per hour or a 53.1 percent reduction in heat losses through the glass when comparing single glazing versus dual glazing. There would be substantial energy savings if the building or residence has a large amount of single glazed window area and the single glazing would be converted to multiple glazing.

A basic problem of retrofitting the single glazed windows to multiple glazed windows is the replacement costs, particularly the costs and inconvenience of replacing the sash and frame. If these costs could be reduced significantly, then a much greater incentive would result for the glazing conversion from single to multiple pane. This would also assist the overall U.S. Government energy plan in reducing energy consumption by conserving energy. The incentive to convert from single glazing to multiple glazing without removing the existing sash and frame can be shown by the following example: The commercial installation costs for wood sash windows, awning type, insulating glass, with dimensions of 2 feet 10 inches × 1 foot 9 inches is;

| MATERIAL | INSTALLATION | SUB-TOTAL | TOTAL - INCLUDING OVERHEAD & PROFIT |
|---|---|---|---|
| $51.00 | $14.00 | $65.00 | $76.00 |

Source: Building Construction Cost Data - 1976
Robert Snow Means Co., Inc.
100 Construction Plaza
Duxbury, Mass. 02332

Additional labor charges would be added to this basic cost of $76.00 for the removal of the existing window, sash and frame. A charge of approximately $24.00 would be required for the additional labor charges, thereby bringing the overall removal and replacement costs to approximately $100.00.

If the same dimensioned single glazed window was retrofitted by attaching another lite of glass supported in a preformed elastomeric (neoprene) glazing gasket with a metal frame, in such a manner to form a hermetic seal, then the costs are as follows:

| MATERIAL | QUANTITY | SUB-TOTAL |
|---|---|---|
| Neoprene Gasket (80¢/ft) | 9.166 L.F. | $7.33 |
| Metal Frame (50¢/ft) | 9.166 L.F. | $4.58 |
| Clear Glasss, ¼" ($1.15/sq ft) | 4.960 sq ft | $5.70 |
| Desiccant (moisture removal) | | $0.50 |
| Desiccant Support Tube | | $1.00 |
| | | $19.11 |
| TOTAL = [$19.11 + $14.00] × 1.145 = $37.91 | | |

Note: $14.00 (Installation) and 1.145 is the Overhead and Profit factor.

Therefore, the cost of retrofitting an existing single glazed window to multiple glazed, insulating glass, is approximately 40% of the cost of completely removing the single glazed window, including sash and frame, and replacing with dual glazing insulating glass.

A principal objective of this invention is to provide a convenient and ecomonical system for converting single glazing to multiple glazing without removing the existing sash and frame. A further objective is to reduce overall energy consumption by reducing the heat transfer through the single pane glazing by retrofitting with multiple pane glazing. A further objective is to reduce water vapor condensation between the multiple lites of glass by the hermetic seal of the glazing gasket and water vapor removal capacity of the desiccant. These and other objects of this invention will become apparent as the description proceeds.

This invention comprises of several essential components when converting from single pane glazing to multiple pane insulating glass, hermetically sealed, when the existing glass sash and frame are not removed. Each of the essential components are described separately and their relationship to the entire system is also described in the foregoing.

PREFORMED ELASTOMERIC GLAZING GASKET & LOCKING STRIP

This mechanical seal type gasket is used to attach a panel of glass to a supporting framework of metal or other construction material. In order to attain the sealing pressures which are required to secure and seal the glass to the frame, the gaskets are made in two parts; the gasket itself and a separate locking strip. To effect the seal, the locking strip is inserted progressively, into a groove that is provided in the gasket. This puts the entire gasket under sufficient compression to produce the required sealing pressure. The glazing gasket shall be formulated of a neoprene compound that exhibits physical properties that meet or exceed the requirements of The American Society for Testing and Materials — ASTM C-542-71*a*. The glazing gaskets shall utilize separate locking strips that are 10 durometer points (Shore A Scale) harder than the gasket body. The glazing gaskets can be fabricated into complete units by utilizing an injection molding process. These preformed elastomeric glazing gaskets with separate locking strip are further described in the 1977 issue of Sweet's Catalog File, Architectural Products for General Building, Division 8, Section 0.27, Sweet's Division, McGraw-Hill Information Systems Co., 1221 Avenue of the Americas, New York, N.Y. 10020. The following companies are listed as suppliers of various types of preformed window gaskets: F. H. Maloney Co., 2301 Texas Avenue, P.O. Box 287, Houston, Texas 77001 and The Standard Products Co., Port Clinton, Ohio, 43452.

METAL SUPPORT FRAME

The metal support frame overall dimensions for the glazing gasket should not deviate more than ±1/16 inch from the nominal size. The surface of the metal frames must be sufficiently smooth and free from rust or other foreign material to permit the sealing lips of the gaskets to function properly. Thickness of the metal flanges that extend into a groove in the glazing gasket must be held to within a tolerance of ± 1/32 inch at all points. Flanges must be free of burrs or other imperfections. Corners must be free of gaps, offsets and weld beads. Untreated steels that are subject to weathering are not suitable for installation of glazing gaskets, although oxidation is limited, enough rust can build up under the gasket lips to impair the seal. The general requirements for the support frames are described in Sweet's Catalog File, Division 8, Section 0.27.

WATER VAPOR REMOVAL DESICCANT & METAL SUPPORT TUBE

A suitable water vapor removal desiccant is placed in another groove in the neoprene glazing gasket in the air gap space between the multiple lites of glass to control condensation of of moisture. A suitable metal support tube (small bore) can be used to house the desiccant. The metal support tube shall be perforated in such a manner to allow water vapor molecules to pass through the openings but prevent the desiccant from traveling through the openings. Originally silica gel had been used by a majority of insulating glass manufacturers. It was originally chosen because of its high capacity for water vapor and low relative cost. Silica gel is a granular amorphous, extremely porous form of silica. Its high surface area and the large number of submicron size pores enable this desiccant to absorb approximately 40 percent of its own weight.

More recently, Molecular Sieves are being considered for water vapor emoval in insulating glass units. Molecular Sieves are synthetically produced crystalline metal alumino-silicates that have been activated for adsorption by removal of the water of hydration. Because structural changes do not occur during dehydration, unusual highly porous adsorbents are formed that have high water affinity, particularly at low water vapor concentrations and at temperatures above room temperature. Molecular Sieves are supplied as a small, hard spherical bead or a fine granulated mesh or powder. Because of their high water capacity at low water concentrations, the same degree of dryness can be obtained in a sealed insulating window unit with a smaller quantity of Molecular Sieves than silica gel requires. Molecular Sieve information was obtained from the following articles by Union Carbide Corporation, Linde Molecular Sieve Division, 270 Park Avenue, New York, N.Y. 10017:

(1) MOLSIV adsorbent, the super protection for insulating windows.

(2) Product Improvement in Insulating Glass.

(3) The Role of Molecular Sieves.

(4) Linde Molecular Sieves, bulletin F-1979C.

Insulating window manufacturers recommend that window sealing for insulating glass units be accomplished at not more than 50 percent relative humidity, preferably lower, and at temperatures between 50° to 80° F.

The following calculations are used to determine the amount of desiccant required for a typical insulating glass window: Window type: Malta - Town and Country, glass size, approximately 16 inches × 38 inches. Assume ⅝ inch air gap between the two lites of glass and air at 50% relative humidity and 80° F. Air at these conditions contains 5.53 grains of water vapor per cubic foot. Volume of air gap: (16 inches × 38 inches × ⅝ inch) = 0.2199 cu ft. Therefore, the 0.2199 cu ft air gap contains 0.0788 grams of moisture. The MOLSIV (Molecular Sieve) desiccant can remove up to 20 wt. % of moisture. If 5 grams of adsorbent were used, then its capacity for water vapor would be about 1 gram. Theoretically 5 grams of the MOLSIV desiccant would be sufficient for the 16 inches × 38 inches insulating glass window with a ⅝ inch gap since only 0.0788 grams of moisture would be sealed in originally based on 50% relative humidity at 80° F. A larger amount of desiccant would normally be used since a certain amount of water vapor will penetrate into the dehydrated air space due to leakage at corners, and permeability of moisture.

The invention may be better understood by reference to the full-scale drawings in which.

Figure 1:
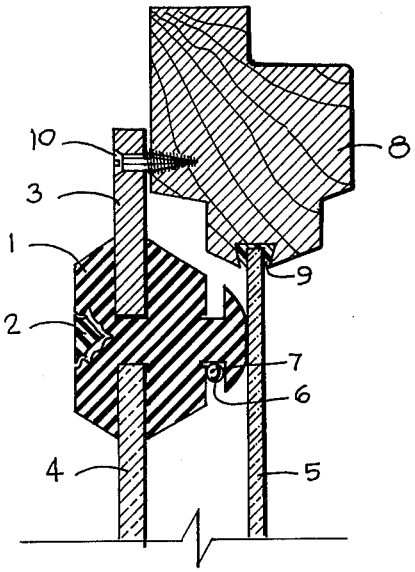
FIG. 1 shows a cross-sectional drawing of the method of converting single pane glass to multiple pane hermetically sealed insulating glass without removing the existing sash. The existing wood sash used for this example is a typical configuration.
Figure 2:
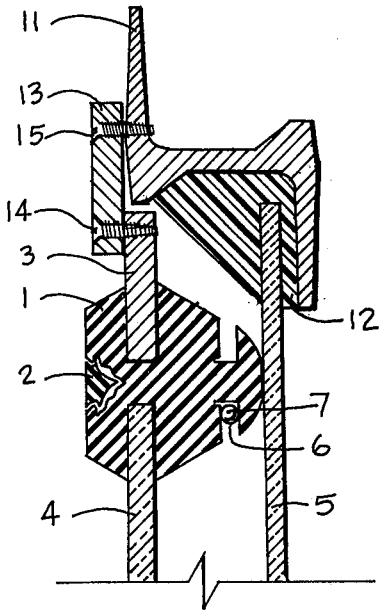
FIG. 2 shows a cross sectional drawing of the same method of conversion illustrated in FIG. 1, with the exception that the existing sash is steel for this example. The existing steel sash is a typical configuration.
Figure 3:
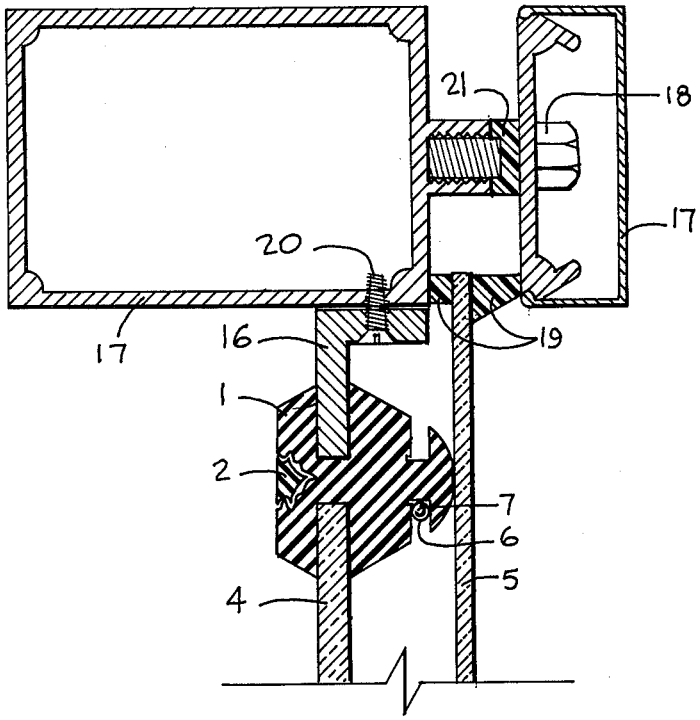
FIG. 3 shows a cross-section drawing of the same method of conversion illustrated in FIGS. 1 and 2, with the exception that the existing sash is a typical aluminum curtain wall configuration.

The parts of the single glazed existing system are listed for each Figure. FIG. 1; parts 5,8, and 9. FIG. 2; parts 5, 11, and 12. FIG. 3; parts 5,17,18,19, and 21.

Referring to FIG. 1, the neoprene preformed elastomeric glazing gasket 1 containing locking strip 2 is supported on a metal frame 3. A glass pane 4 is supported in a groove in glazing gasket 1. The existing glass pane 5 is supported in the existing wood sash 8 containing existing caulking 9. A small bore perforated metal tubing 6 houses the water vapor removal desiccant 7. The entire frame is attached to the existing wood sash by suitable fastner 10. The glazing gasket 1 is mechanically compressed against the existing pane of glass by the force of the fastner 10 when the metal support frame 3 is tightened against the existing wood sash 8.

Referring to FIG. 2, the drawing illustrates essentially the same method as described in FIG. 1, with the exception that the existing sash 11 is steel instead of wood. Parts 1 through 7 are the same in FIGS. 1 and 2. Existing glass 5 is supported in steel sash 11 (existing) by existing metal caulking 12. A rectangular shaped metal 13 is required to attach the metal support frame 3 to existing steel sash 11. A suitable fastner 14 is required to attach the metal support frame 3 to the rectangular shaped metal 13 and a suitable fastner 15 is required to attach the rectangular shaped metal 13 to the existing steel sash 11.

Referring to FIG. 3, the drawing illustrates essentially the same method as described in FIGS. 1 and 2, with the exception that the existing curtain wall assembly sash 17 is aluminum instead of wood or steel. Parts 1,2,4,5,6, and 7 are the same in FIGS. 1,2 and 3. Existing glass 5 is supported in the aluminum curtain wall assembly 17 by a rubber gasket 19. The metal support frame 16 for the neoprene glazing gasket 1 serves the same function as the other gasket support frames 3 in FIGS. 1 and 2, however it is L-shaped. The existing aluminum curtain wall assembly 17 contains an existing locking bolt 18 and a neoprene thermal barrier 21 (existing). A suitable fastner 20 is required to attach the metal support frame 16 to the curtain wall assembly 17 (existing). Clearances are predetermined before the frame is assembled so as to allow about a 5–10% compression of the glazing gasket 1 when it is tightened against the existing glass pane 5. It is this compression of the glazing gasket 1 against the existing glass pane 5 that prevents water vapor and air from entering the air gap space between the two lites of glass.

It will be obvious that the construction of the inventive system may be varied so long as the basic requirements are maintained. The invention provides a method of converting single pane glass to multiple pane hermetically sealed insulating glass without removing the existing glass sash and frame. The invention would reduce the conversion costs from single glazing to multiple glazing significantly. The insulating glass unit would reduce the heat transfer significantly and assist the U.S. Government energy plan in reducing energy consumption by conserving energy.

While certain specific embodiments and preferred modes of practice of the invention have been described, it will be understood that this is solely for illustration, and that various changes and modifications may be made without departing from the disclosure or the scope of the appended claim.

I claim:

1. An assembly for adding a glass pane to an existing window without removing the existing sash and frame comprising;

a support frame defining a continuous inwardly directed flange which may be secured to the sash spaced from the existing pane, a gasket having two slots opening away from each other, a sealing rib extending generally perpendicular to the two slots and a groove opposite the sealing rib, such that one slot engages the continuously inward directed flange, the other slot engages the additional pane, the sealing rib abuts the existing pane to seal the space between it and the additional pane, and a retaining strip which may be snapped into the groove opposite the sealing rib to secure the additional pane in place.

2. An assembly according to claim 1 in which a groove is provided in the gasket between the slot for engaging the additional pane and the sealing rib, and further comprising a tubular perforated desiccant container laid within the slot.

3. A method of adding a glass pane to an existing window without removing the existing sash and frame which comprises the steps for (a) fixing a supporting frame to the existing sash, said supporting frame defining a continuous inwardly directed flange, (b) placing a gasket upon the flange of the supporting frame, said gasket having two slots opening away from each other the one slot being placed over the said flange, (c) placing the added pane into the other slot in the gasket, said gasket having a sealing rib extending perpendicular to the slots and abutting the existing pane to seal a space between the two panes, and (d) placing a retaining strip into the gasket in a groove provided therefore opposite the sealing rib to lock the added pane and gasket into position.

* * * * *